United States Patent [19]

Kasai

[11] Patent Number: 4,870,800

[45] Date of Patent: Oct. 3, 1989

[54] INERT GAS-FILLING AND SEALING DEVICE, HEAT SEALING DEVICE AND PACKAGING APPARATUS USING THESE DEVICES

[75] Inventor: Ryusuke Kasai, Kiyose, Japan

[73] Assignee: Nikka Co., Ltd., Kanagawa, Japan

[21] Appl. No.: 272,812

[22] Filed: Nov. 18, 1988

[30] Foreign Application Priority Data

Apr. 5, 1988 [JP] Japan ..... 63-83585
May 25, 1988 [JP] Japan ..... 63-69020

[51] Int. Cl.[4] ..... B65B 31/06; B30B 15/34

[52] U.S. Cl. ..... 53/88; 53/329; 53/510; 156/69; 156/583.1

[58] Field of Search ..... 53/88, 282, 329, 373, 53/432, 510; 156/69, 583.1

[56] References Cited

U.S. PATENT DOCUMENTS

| | | | |
|---|---|---|---|
| 3,189,505 | 6/1965 | Sloan et al. | 53/433 X |
| 3,283,469 | 11/1966 | McBrady et al. | 53/432 |
| 3,481,100 | 12/1969 | Bergstrom | 53/511 X |
| 3,664,085 | 5/1972 | Rousseau et al. | 53/510 |
| 3,720,038 | 3/1973 | Bryan, Jr. et al. | 53/373 X |
| 3,992,850 | 11/1976 | Vetter | 53/510 |
| 4,009,552 | 3/1977 | Schlachter | 53/510 X |
| 4,162,599 | 7/1979 | Kyle | 53/77 |
| 4,201,030 | 5/1980 | Mahaffy et al. | 53/510 X |
| 4,685,274 | 8/1987 | Garwood | 53/453 X |

*Primary Examiner*—Robert L. Spruill
*Assistant Examiner*—Beth Bianca
*Attorney, Agent, or Firm*—Birch, Stewart, Kolasch & Birch

[57] ABSTRACT

An inert gas-filling and packaging apparatus which is adapted to fill an inert gas in containers, each having a content and seal the containers one by one after coverage of an opening of the container with a sealing film is described. The apparatus comprises a plurality of buckets for individually receiving a container having an upper opening, a film supplying means for supplying a sealing film arranged to move over the plural buckets, a vertically movable keep pad for keeping the sealing film in contact with the upper face of the bucket, the contact member having grooves provided at opposite sides of the plural buckets, through which the nozzle is inserted to inject an inert gas, and a nozzle for injecting the inert gas. The sealing film is sealed on the container by means of a heat sealing means surrounded by the keep pad. The heat sealing by the apparatus ensures a good appearance of a final product without involving any wrinkles in the sealed film. A heat sealer is also described having two sealing members which are controlled to operate at different sealing forces whereby easy peeling of the sealed film is ensured. When this heat sealer is applied to the inert gas filling and packaging apparatus, ideal heat sealing is realized.

8 Claims, 9 Drawing Sheets

INERT GAS-FILLING AND SEALING DEVICE, HEAT SEALING DEVICE AND PACKAGING APPARATUS USING THESE DEVICES

BACKGROUND OF THE INVENTION

1. Field of the Invention

This invention relates to an inert gas-filling and sealing device which is adapted for filling an inert gas under pressure into a container, such as a plastic cup, having food therein, and sealing the container. The present invention also relates to a heat sealing device which is used for heat sealing a sealing film to a cup-like container containing therein. This heat sealing device is particularly suitable for secondarily heat sealing a container which has been first heat-sealed with a film by the use of the above-mentioned inert gas filling and sealing device and ensures satisfactory sealing strength while allowing easy peeling off of a sealed film. Moreover, the invention relates to a packaging apparatus comprising an inert gas filling and sealing device and a heat sealing device.

2. Description of the Prior Art

In recent years, food has been packaged in various ways including one in which the food is placed in a container with an upper opening, and a sealing film cover is placed on the upper opening of the container. Before the film cover is heat sealed along the opening of the container, an inert gas, such as a nitrogen gas, is charged into a head space in the container, substituting the air with the inert gas. Subsequently, the heat sealing is carried out. In this connection, however, if air is left in the head space in large amounts, the content in the container becomes more susceptible to oxidation when subjected to sterilization by retort. Accordingly, it is favorable to make the rate of substitution of the inert gas as high as possible.

For packaging of food by filling an inert gas in a container and sealing the container with a sealing film as set forth above, there is known a method in which one or more containers, each containing food, are placed in a chamber. The chamber is evacuated, after which an inert gas is charged into the chamber to fill the chamber with the gas. In this condition, a sealing film is placed over an opening of the respective containers and heat-sealed. However, this method requires a large-scale apparatus with an excessive amount of inert gas, leading disadvantageously to high costs.

In contrast thereto, an apparatus has been proposed in Japanese Laid-open patent application No. 61-93023, which is simple in construction and requires only a small amount of inert gas, thus ensuring inert gas filling packaging at low costs. This is particularly shown in FIG. 17. In the apparatus there are mounted, on a base (a), a plurality of buckets (b) which move along in the direction of the arrows in the figure. Containers (d), each having a content (c), are placed in the respective buckets (b). When moved to a position, a sealing film (e) comes in contact with an opening of the containers (d) for coverage. Subsequently, the sealing film (e) is preliminarily heat sealed, as (l) in FIG. 18, to a flange (f) (a peripheral portion of an opening) of the container (d) by means of a first heat-sealing plate (i) having a groove (g) for nozzle insertion and a groove (h) for air leakage. By the preliminary heat sealing, a space (j) for nozzle insertion and a space (k) for air leakage, are left unsealed, as particularly shown in FIG. 18. A flat nozzle (m) for filling an inert gas is inserted into the container (d) through the space (j). An inert gas is injected from the tip of the nozzle (m) into the container (d) to expel the air in the container through the space (k) to the outside. As a result, the inert gas can be filled under pressure into the container (d). Subsequently, the nozzle (m) is removed from the container (d) and the sealing film (e) is heat-sealed to the entire face of the flange (f) of the container (d) by means of a second heat-sealing plate (n). As a result, the nozzle insertion space (k) and the air leakage space (k) are closed to seal the container (d).

However, the filling device shown in FIG. 17 is disadvantageous in that the nozzle (m) for filling an inert gas is arranged between the containers (d) and the sealing film (e) along the direction of movement of the containers (d) and the nozzle (m) extends across the center of the opening of some containers (d), so that when the content (c) fluctuates by swinging of the container (d) or when the content (c) is filled to a level of the opening of the container (d), it will attach to the lower face of the nozzle (m). Moreover, the content (c) may deposit on the upper face of the flange (f). In this condition, the sealing film (e) is heat-sealed to the flange (f), making a poor appearance of final products. In addition, this device is so arranged that the sealing film (e) of each container (d) is preliminarily heat-sealed to the flange (f) so as to leave the spaces (j) and (k) for nozzle insertion and air leakage, respectively. It has been often experienced that when final heat-sealing is effected, wrinkles are formed in the sealing film (e) at the portions corresponding to the spaces (j) and (k), thus leading also to a poor appearance of final products.

For sealing a container with a film, it is the common practice that, as shown in FIG. 19, a container (q) having a content (p) is inserted into a bucket (o) and a sealing film (r) is provided to cover an opening of the container (q). Subsequently, a metal sealer (s) provided above the bucket (o) is dropped until the sealing film (r) is pressed against a ring flange (u) along an opening of the container (q) by means of a ring press portion of the sealer (s) heated to a given temperature. In this manner, the sealing film (r) is heat-sealed to the ring flange (u) of the container (q).

The sealer (s) includes, as shown in FIG. 19, the ring press portion (t). The contacting face of the press portion (t) to the sealing film (r) is flat and is arranged in parallel to the ring flange (r), so that the sealing film (u) can be pressed uniformly against the ring flange (u).

For the heat-sealing of the film (r) to the container (q), a heat sealing strength should be not less than a predetermined level (e.g. 2.3 kg/ 15 mm) in order to prevent separation of the film.

However, when the known sealer (s) is used for heat-sealing, a uniform sealing pressure is exerted on the sealing film (r). The portion of the film, i.e. the whole surface of the flange (n), which has been sealed, has a sealed strength which is higher than a predetermined strength. When the container is opened, the sealed film (r) cannot simply be removed from the container (q). For the sealing of the container (q), a heat-sealing strength over a certain level is required as mentioned above. However, when the film is uniformly heat-sealed at the whole surface of the flange (u), a marginal portion of the sealed film from which separation is to be started is also sealed at the certain level of the strength. The sealing of the portion to be initially separated at a strength higher than the certain level undesirably requires a great separation force, requiring much labor for opening the container (q).

SUMMARY OF THE INVENTION

It is therefore an object of the invention to provide a continuously inert gas-filling and packaging apparatus which is simple in construction and is capable of gas-filled packaging using a small amount of an inert gas with a high substitution rate of the inert gas.

It is another object of the invention to provide a continuously inert gas-filling and packaging apparatus which is substantially free of deposition of a content on a gas-filling nozzle and in which the sealing film is not wrinkled, with good appearance of the final packages.

It is a further object of the invention to provide a continuous heat sealer which is capable of yielding sufficient seal strength while permitting a sealed film to be readily removed from a container.

It is still a further object of the invention to provide a continuous heat sealer which is adapted for use in combination with a continuously inert gas-filling and packaging device in which a container initially heat-sealed with the device is subsequently heat-sealed with the continuous heat sealer.

It is another object of the invention to provide a continuous packaging apparatus which comprises an inert gas-filling and packaging device and a heat sealer of the type as mentioned above, whereby an easy opening, inert gas-filled package is possible.

In accordance with one embodiment of the invention there is provided a sealing apparatus which is adapted to fill inert gas in containers, each containing a content such as a food, and seal the containers one by one after coverage of an opening of the container with a sealing film. The apparatus includes:

a plurality of buckets for individually receiving a container having an upper opening, the plurality of buckets being moved in a predetermined direction;

a film supplying means for supplying a sealing film arranged to move over the plural buckets in synchronism with the moving speed of the buckets and to cover one of the containers in position;

a vertically movable keep pad having a contact member and capable of moving downward to keep the sealing film in contact with the upper face of the bucket through the contact member when the film is placed in position to cover the opening of the container, the contact member having grooves provided at right-angle sides with respect to the direction of the movement of the plural buckets, through which the nozzle is inserted to inject an inert gas, and air in the container is expelled by the action of the injected gas, respectively;

a nozzle located at one side of the moving buckets and capable of moving laterally substantially at right angles with respect to the direction of the movement of the plural buckets and injecting the inert gas from the tip thereof through the insertion groove of the keep pad when the film is brought into contact with the upper face of the bucket; and a vertically movable heat sealing means normally located above the plural buckets, surrounded with the keep pad so that the keep pad and the heat sealing means are separately movable, and having a tip member of a form corresponding to a margin of the opening of the container, whereby when the sealing film is urged against the upper face of the bucket, the nozzle is advanced until the tip is inserted through the nozzle insertion groove, from which an inert gas is injected into the container to expel the air to the outside from the other groove, and the heat-sealing means descends to heat seal the film along the margin of the container.

In this apparatus, the nozzle for filling the inert gas is inserted at the tip thereof into the insertion groove of the keep pad from one side with respect to the direction of the movement of the plurality of buckets. Subsequently, the inert gas is injected from the nozzle into the container to substitute the air in the container with the inert gas. The nozzle tip is not inserted into the container body when the inert gas is filled. This prevents the nozzle at the lower side from depositing with the content. In addition, the sealing film is heat-sealed at one time over the entire marginal face of the opening, so that the sealed film is free from wrinkles, as will be experienced in two heat-sealing procedures.

According to another embodiment of the invention, there is provided a heat sealer which is adapted for heat sealing a container along a marginal portion of an opening of the container with a sealing film. The heat sealer includes a vertically movable inner sealing member of a form suitable for heat sealing the container, the inner sealing member having a tip press portion projected at the center with respect to the thickness of the inner sealing member, and a vertically movable outer sealing member arranged to surround the inner sealing member and having a tip press portion projected at the center with respect to the thickness of the outer sealing member. The inner and outer sealing members, heated to predetermined temperatures, respectively, are arranged such that when a sealing film placed on the container is heat-sealed, the film is pressed at a higher force at the tip press portion of the inner sealing member than at the outer sealing member.

It is generally the case that when heat sealing is effected using a heat sealer, a high sealing pressure results in a high seal strength for a given sealing temperature. The heat sealer according to the invention has the inner and outer sealing members, which are arranged such that at the time of the heat sealing, the press portion of the inner sealing member is higher in press force than the press portion of the outer sealing member. As a result, the sealed film has a higher seal strength at an inner portion where sealed with the inner sealing member than at an outer portion where sealed with the outer sealing member. For instance, when the inner portion of the film is sealed at a strength not smaller than about 2.3 kg/15 mm, the outer portion may be sealed at a lower strength. This permits the outer portion to be readily peeled off when the sealed film is removed. The case where the inner portion is sealed at a high strength of about 2.3 kg/15 mm or greater is different from a case where all the portion to be sealed is sealed at such a high strength. In the former case, the removal of the film can start from the outer portion which is more likely to be removed because of the lower strength. This leads to smooth removal of the inner portion and allows the sealed film, as a whole, to be removed smoothly and at a small force. On the other hand, the inner portion has sufficient sealed strength and is not readily removed by ordinary handling.

In the heat sealer of the invention, the press portions of the inner and outer sealing members are both in the form of a ring projected at the central portion with respect to the thickness of the ring. The centrally projected portions of the respective members can press the sealing film more strongly than the side portions of the press portions, respectively. This manner of the heat sealing is advantageous in that when the inner and outer sealed portions of the film are removed, removal starts from a portion of a lower seal strength, ensuring smooth removal of the sealed film.

In the practice of the invention, it is more convenient to first heat seal a container with a sealing film by the use of an inert gas-filling and packaging apparatus of the type described before where a container has an opening of a circular or ring form, and secondly to fully heat seal the film by the use of the heat sealer described above. More particularly, the sealing film is preliminarily heat sealed at a relatively small strength and then completely heat sealed by means of the heat sealer having the inner and outer members. The final package can be heat sealed in an easy opening way.

BRIEF DESCRIPTION OF THE DRAWINGS

The above and other objects, features and advantages of the present invention will become apparent from the following description taken in conjunction with the accompanying drawings, in which.

DETAILED DISCUSSION

Figure 1:
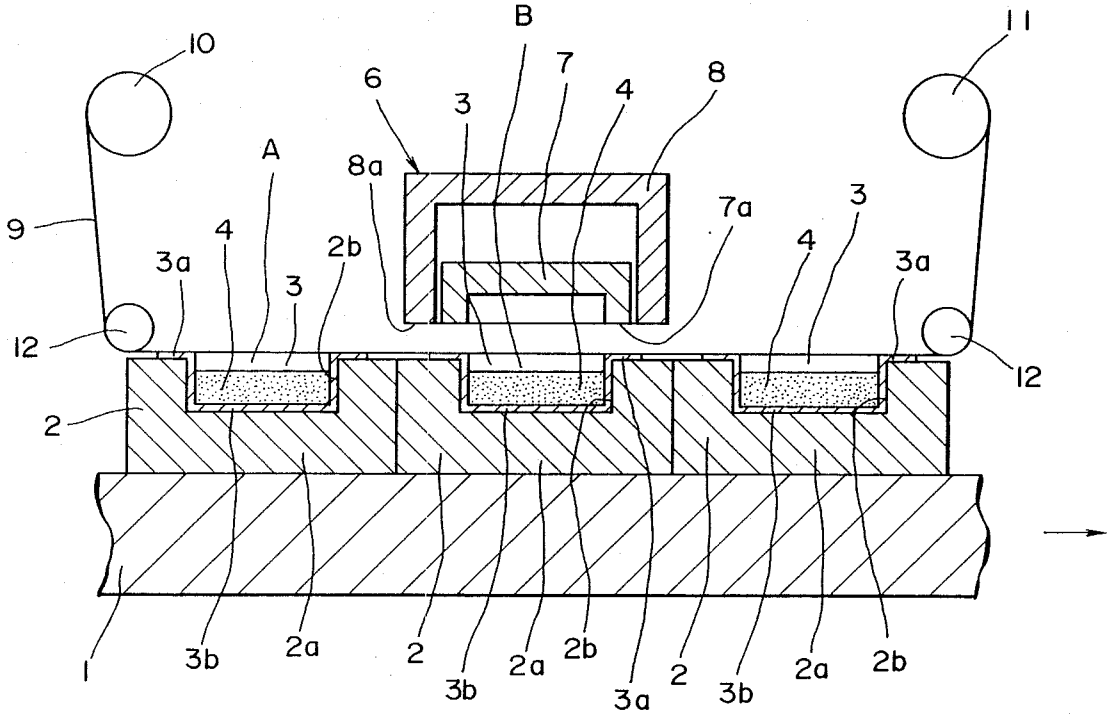
FIG. 1 is a schematic sectional view of an inert gas-filling and packaging apparatus according to one embodiment of the invention.

Now, reference is made to the accompanying drawings, in which like reference numerals indicate like parts, and particular to FIGS. 1 to 8 which show an inert gas-filling and packaging apparatus according to the invention and related parts or units used in the apparatus.

Figure 2:
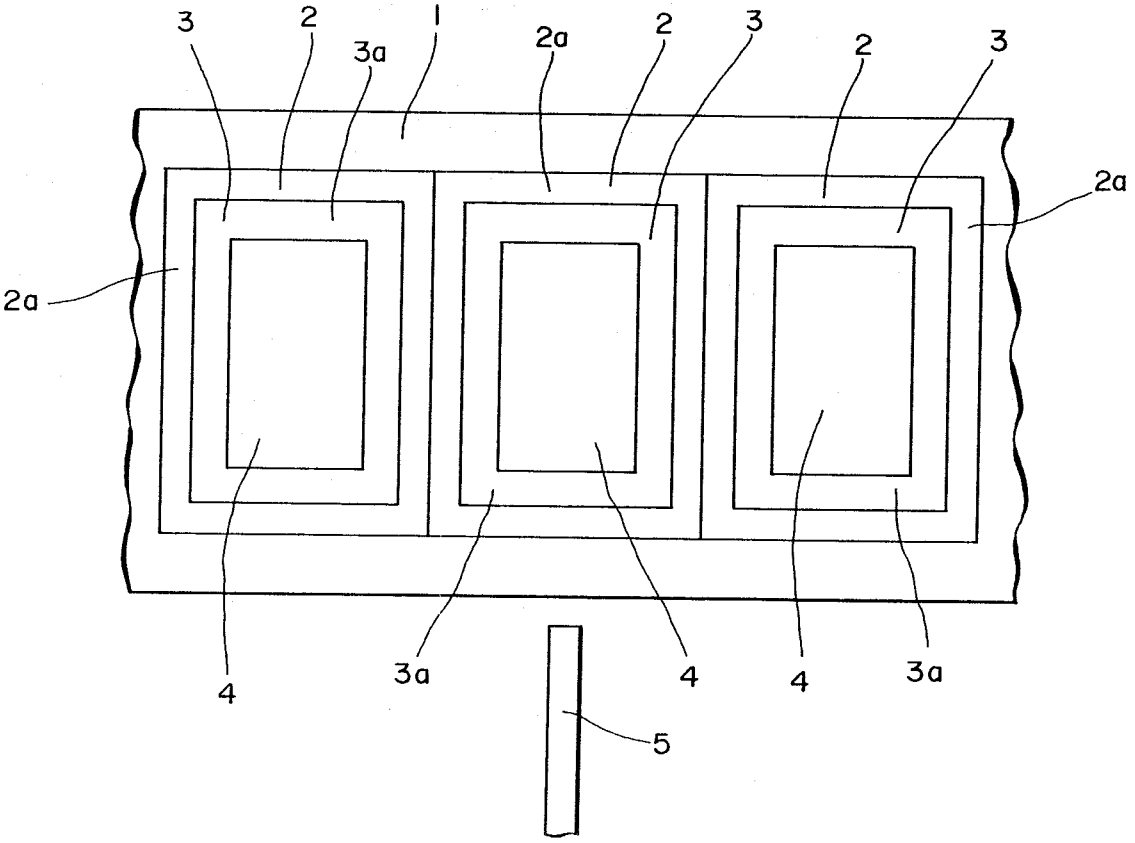
FIG. 2 is a schematic plan view of part of the apparatus of FIG. 1.

In FIGS. 1 and 2, there is shown the apparatus which includes a base 1 and a plurality of buckets 2 for receiving a container in each bucket. The buckets are arranged to be automatically moved by a suitable means, such as a cylinder, along the arrow in the figure. Each bucket 2 has a rectangular body 2*a* having a rectangular recess 2*b* at the central portion thereof. Into the recess 2*b* is inserted a plastic container 3 having a substantially rectangular dish body 3*b*. The plastic container 3 has an upper opening with a flange 3*a*. The respective buckets 2 have the containers 3 each containing a content 4 as shown.

Figure 3:
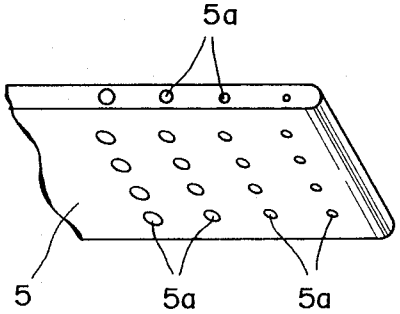
FIG. 3 is a schematic perspective view of a tip of a nozzle used in the apparatus.
Figure 4:
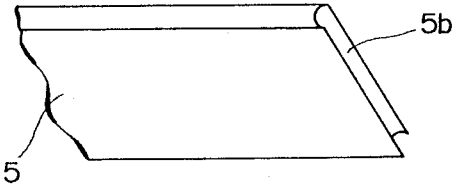
FIG. 4 is a schematic perspective view showing another embodiment of a nozzle tip.

At one side of the buckets, with respect to the direction of movement of the buckets, there is provided an inert gas-filling nozzle 5, as shown in FIG. 2. This nozzle 5 is movable along directions at right angles with respect to the direction of the movement of the buckets 2 in a manner as described hereinafter. The nozzle 5 has a flat form, as shown in FIG. 3, and has a number of injection holes 5*a* at side and bottom walls of the tip of the nozzle 5, from which an inert gas is injected. The injection holes 5*a* are so formed as to be smaller in size toward the end of the tip, as is particularly shown in FIG. 3. By this, an injected inert gas is more likely to go ahead. Depending upon the type of content or the amount of moisture in the content, another type of nozzle, as shown in FIG. 4, may be used. The nozzle 5 of FIG. 4 has an injection hole 5*b* of a substantially rectangular form extending along the width of the nozzle 5.

Figure 5:
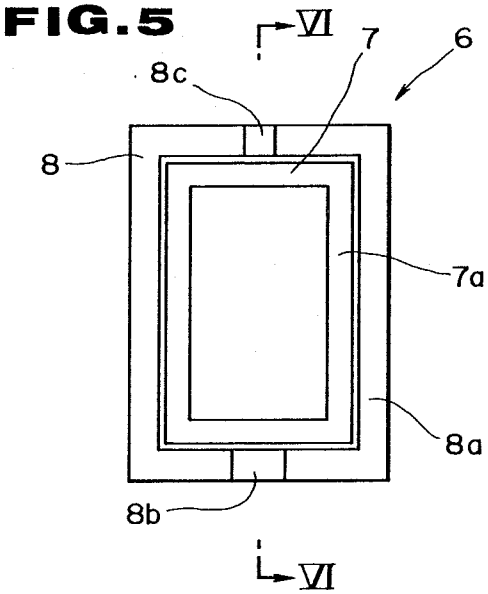
FIG. 5 is a schematic bottom view of a heat sealer of the apparatus.
Figure 6:
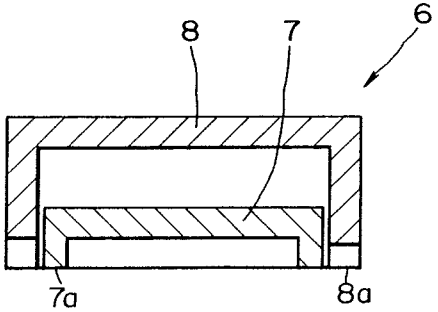
FIG. 6 is a sectional view taken along the line VI—VI of FIG. 5.

The apparatus of FIG. 1 further includes a heat-sealing unit or means 6 located in position above the buckets 2. This unit 6 consists of a heat-sealing member 7 and a keep pad 8 provided to surround the member 7. The heat-sealing member 7 has, as shown in FIGS. 5 and 6, a contact portion 7*a* of a rectangular form corresponding to the flange 3*a* of the container 3 and is vertically movable. The keep pad 8 also has a contact portion 8*a* of a rectangular form which is brought into contact with the bucket 2 on the upper surface thereof, as shown in FIGS. 5 and 6. This contact portion 8*a* has a groove 8*b*, through which the nozzle 5 is inserted, at the side where the nozzle is provided. At the opposite side, an air leakage groove 8*c* is formed in the pad 8. The pad 8 may have a plurality of air leakage grooves 8*c*, if desired, to facilitate the air to expel. This pad 8 is vertically movable independently of the vertical movement of the heat sealing unit 7.

A sealing film 9 is supplied from a film roll 10 and taken up with a take-up roll 11 at a speed in synchronism with the speed of movement of the buckets 2. The sealing film 9 is arranged to cover the opening of the containers 3 by means of guide rollers 12, 12 kept from each other, as shown.

In operation for filling an inert gas in the container 3 having the content 4 and sealing the container 3 with the sealing film 9, the plural buckets 2 are moved successively along in the direction of the arrow. When the container 3 reaches a position A, the opening of the container 3 is covered with the film 9.

Figure 7:
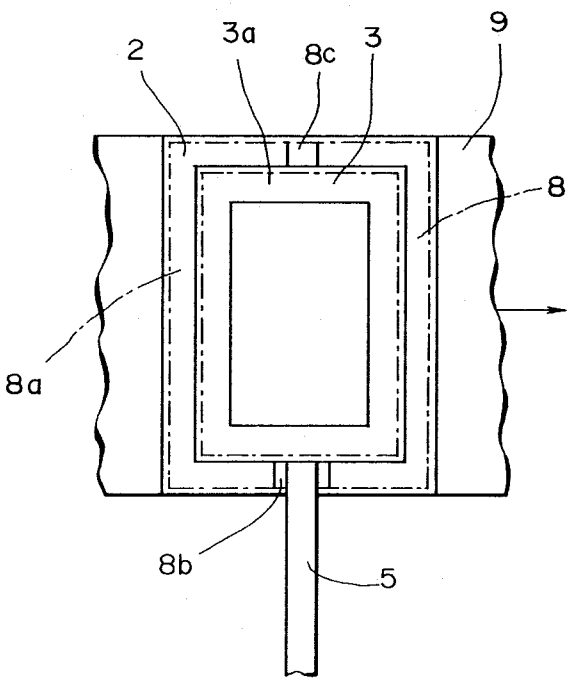
FIG. 7 is an illustrative view showing the state where a sealing film is pressed against a bucket by means of a keep pad.

Subsequently, when the covered container 3 reaches a position B below the heat sealing unit or mechanism 6, the keep pad 8 descends to keep the film 9 in contact with the upper surface of the bucket 2, as is particularly shown in FIG. 7. It will be noted here that the portions of the film 9 corresponding to the grooves 8*b* and 8*c*, respectively, are not contacted with the bucket 2, thus permitting spaces between the film and the grooves of the bucket. The keep pad 8 is also in contact with the outer edge portion of the flange 3*a* of the container 3. In this condition, the nozzle 5 is moved toward the groove 8*b* and its tip is inserted into the groove 8*b* provided below the sealing film 9, as is shown in FIG. 7. Thereafter, an inert gas from a gas source (not shown) is injected from the injection holes 5*a* of the nozzle 5 into the container 3, whereupon the air in the container 3 is expelled therefrom through the groove 8*c*. The inert gas is charged into the container to an extent of a positive pressure of the gas.

Figure 8:
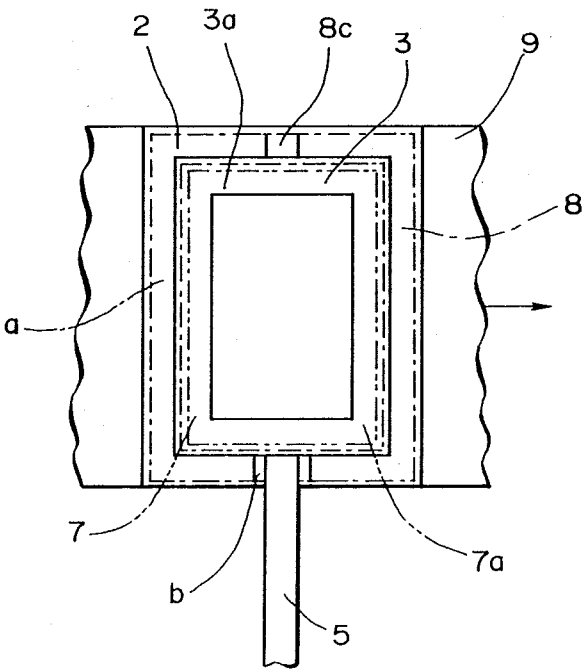
FIG. 8 is an illustrate view showing the state where the sealing film is heat-sealed to a flange of a container by the use of a heat sealing member.

Then, the heat sealing member 7 descends so that the contact portion 7*a* heated to a predetermined temperature is pressed against the flange 3*a*, as shown in FIG. 8. As a result, the sealing film 9 is heat-sealed entirely over the flange 3*a* to sealingly close the container. In this connection, however, if the tip of the nozzle 5 is extended below the heat sealing member 7 when the inert gas has been filled, the nozzle is retarded to an extent not impeding the heat sealing, followed by the descent of the heat sealing member 7. After completion of the sealing operation, the heat sealing member 7 and the keep pad 8 are raised simultaneously to their original positions, along with the nozzle, so as to be returned to the original position.

If necessary, the sealed film 9 may be trimmed or subjected to second heat sealing for allowing easy opening at a position downstream of the first heat sealing position with respect to the running direction of the buckets.

Figure 17:
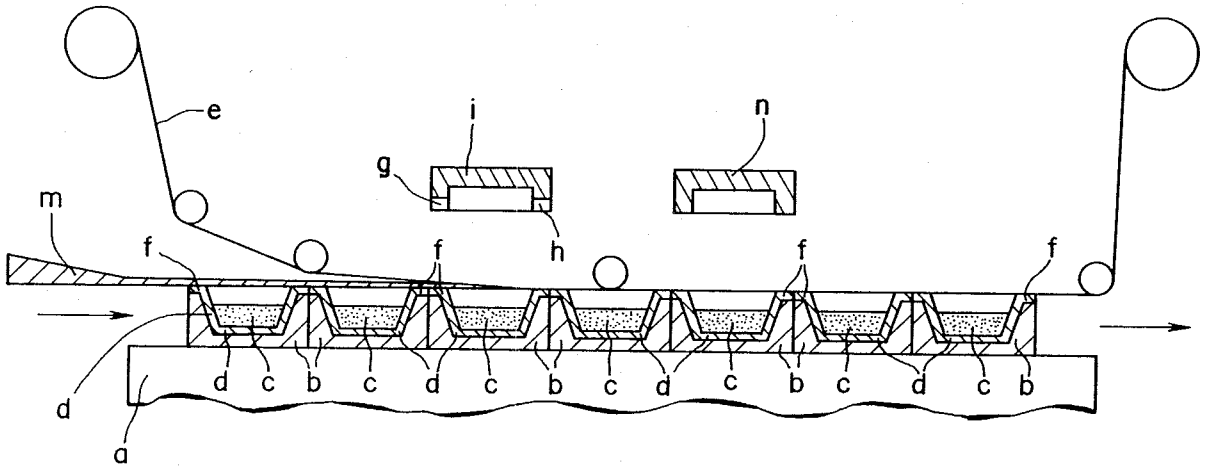
FIG. 17 is a schematic sectional view illustrating a known inert gas-filling and packaging apparatus.
Figure 19:
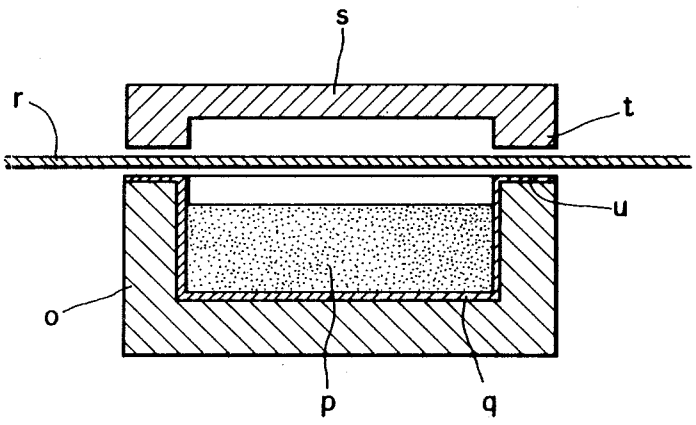
FIG. 19 is a schematic sectional view showing the state where the sealing film is in a condition of being heat-sealed to a container by means of the known heat sealing member.
Figure 18:
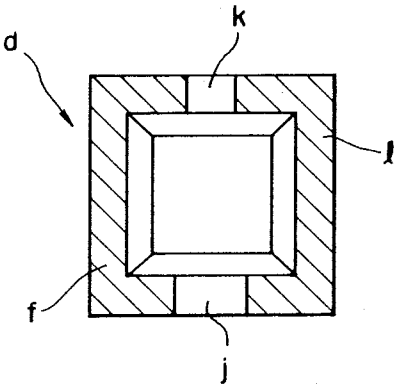
FIG. 18 is a sectional view showing the state where the sealing film is preliminarily heat-sealed to a flange by means of a first heat sealing member of the known apparatus.

The apparatus illustrated above is arranged in such a way that the tip of the nozzle 5 is inserted into the groove 8*b* from one side with respect to the running direction of the containers 3. Accordingly, the nozzle 5 does not pass into the container 3 as will be experienced in the known apparatus illustrated in FIG. 17. Any disadvantages such as deposition of the content 4 on the lower side of the nozzle 5 and also on the flange 3*a* of the container 3 cannot be involved. Moreover, the heat sealing of the film 9 is effected at one time, so that the sealed film 9 does not wrinkle as will occur in the case of the inert gas-filling and packaging apparatus of FIG. 17. Additionally, since the sealing film is held with the keep pad 8 and the inert gas is injected from the groove 8*b* of the pad 8, it is easy to charge the inert gas into the container 3 at a positive pressure, making it possible to increase a substitution rate of the inert gas.

Although the apparatus is illustrated using a container of rectangular form, various forms may be used including circular, oval and the like forms. In this case, the forms of the bucket, heat-sealing member and keep pad should be varied accordingly.

Figure 9:
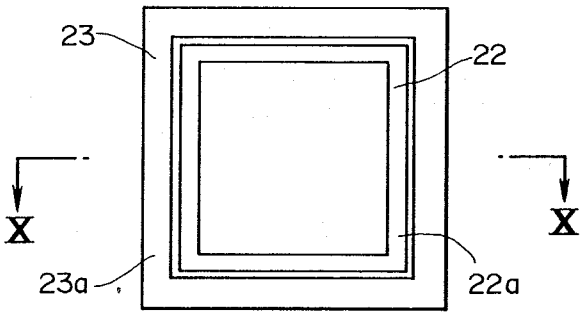
FIG. 9 is bottom view of a heat sealer according to another embodiment of the invention.
Figure 10:
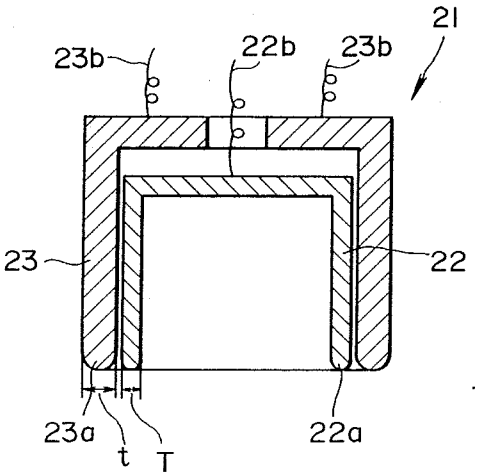
FIG. 10 is a sectional view of the heat sealer taken along the line X—X.

FIGS. 9 and 10 show a heat sealer according to the invention.

The heat sealer is generally indicated at 21 and includes an inner sealing member 22 which is vertically movable. The inner sealing member 22 has at its tip a square press portion 22*a* having a substantially semi-circular section as shown. The heat sealer 21 has also an outer sealing member 23 of a square form which is kept apart from the inner sealing member 22 and is vertically movable independently of the inner sealing member 22. The outer sealing member 23 has also a square press portion 23*a* having a tip of a semi-circular form in section. A lead 22*b* and leads 23*b*, 23*b* are connected to the inner and outer members 22, and 23, respectively.

Figure 11:
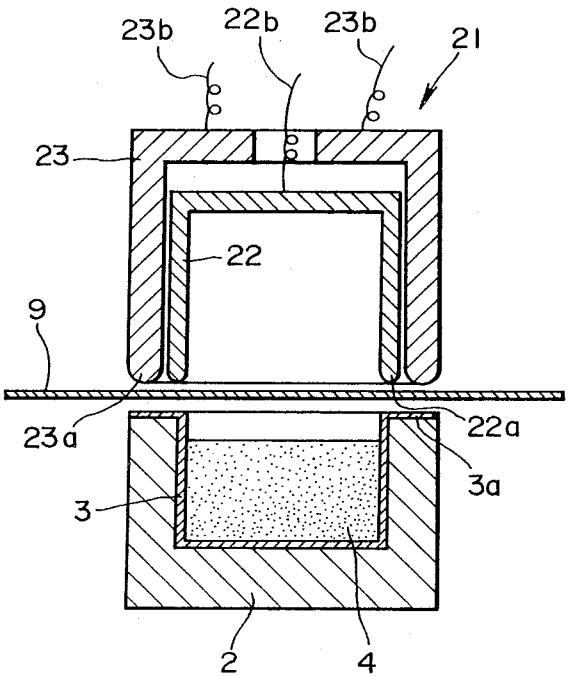
FIG. 11 is a schematic sectional view showing the state where a sealing film is heat-sealed to a container by the heat sealer.

For heat-sealing a sealing film to an opening of a container by the use of this heat sealer, a container 3 having a content 4 is inserted into a bucket 2, as is particularly shown in FIG. 11. A sealing film 9 for easy peeling is placed over the opening of the container 3. Thereafter, the sealing members 22 and 23 having, respectively, the press portions 22*a* and 23*a* heated to predetermined temperatures, descend to force the sealing film 9 against a flange 3*a* of the opening of the container 3, thereby heat-sealing the film to the flange 3*a*. The heat sealer 21 of the invention is arranged such that a higher pressure is applied to the sealing film 9 at the press portion 22*a* of the inner sealing member 22 than at the press portion 23*a* of the outer sealing member 23. Preferably, a strength of a sealed portion with the inner sealing member 22 may be set in a range of not lower than about 2.3 kg/15 mm, more preferably about 2.3 to about 2.5 kg/mm, whereas a strength of a sealed portion with the outer sealing member is lower than that with the inner portion and may be set in a range of about 0.4 to 2.3 kg/15 mm. It is important that the press portions 22*a* and 23*a* of the inner and outer sealing members 22 and 23 should preferably have a substantially semi-circular form in section. By this, the sealing film 9 is pressed at a higher force along a center line of the respective press portions 22*a*, and 23*a* than along side lines with respect to the thickness of the press portions. In this connection, it is preferred that a ratio of a width of a sealing part with the inner press portion 22*a* and a width of sealing part with the outer press portion 23*a* is in the range of about 1:2 to about 2:3. In practice, the sealing width is preferably about 1 to about 1.5 mm for the inner press portion 22*a* and from about 2 to about 3 mm for the outer press portion 23*a*.

As will be apparent from the above, the heat sealer 21 of the invention is advantageous in that since the strength of a sealed portion with the outer sealing member 23 is lower than the strength of a sealed portion with the inner sealing member 22 and the side sealed portions are made lower in strength than the central portion for both the inner and outer sealed portions, the sealed film 9 can be more easily opened than a film uniformly sealed at high strength.

Figure 12:
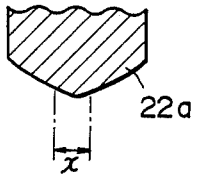
FIGS. 12 to 15 are, respectively, illustrative views, in section, of press portions of a seal member.
Figure 13:
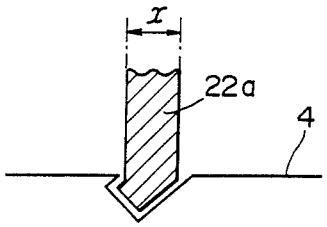
Figure 14:
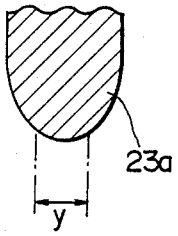
Figure 15:
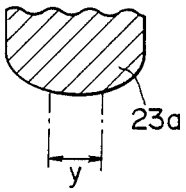

The heat sealer 21 illustrated above has the inner and outer press portions of a square form. The press portions may be arbitrarily varied in form depending upon the form of the container used. For instance, the press portions may take various forms including a circular or oval form. Moreover, the press portions 22*a* and 23*a* of the inner and outer members 22 and 23 are illustrated as having a semi-circular form in section, but are not limited to this form. For instance, the inner press portions 22*a* may be in the form of a ship's bottom or substantially in the form of a triangle, in section, as particularly shown in FIGS. 12 and 13. The outer press portions 23*a* may be in the form of an oval section, as is shown in FIGS. 14 and 15. So far as the tip press portions are projected at the center with respect to the thicknesses T, t of the sealing members, any form may be taken for the inner and outer press portions as desired. For the press portion 22*a* of FIGS. 12 and 13, the seal width, x, should preferably be in the range of from about 2 to about 3 mm. For the press portion 23*a* of FIGS. 14 and 15, the seal width, y, should preferably be in the range of from about 1 to about 1.5 mm.

Figure 16:
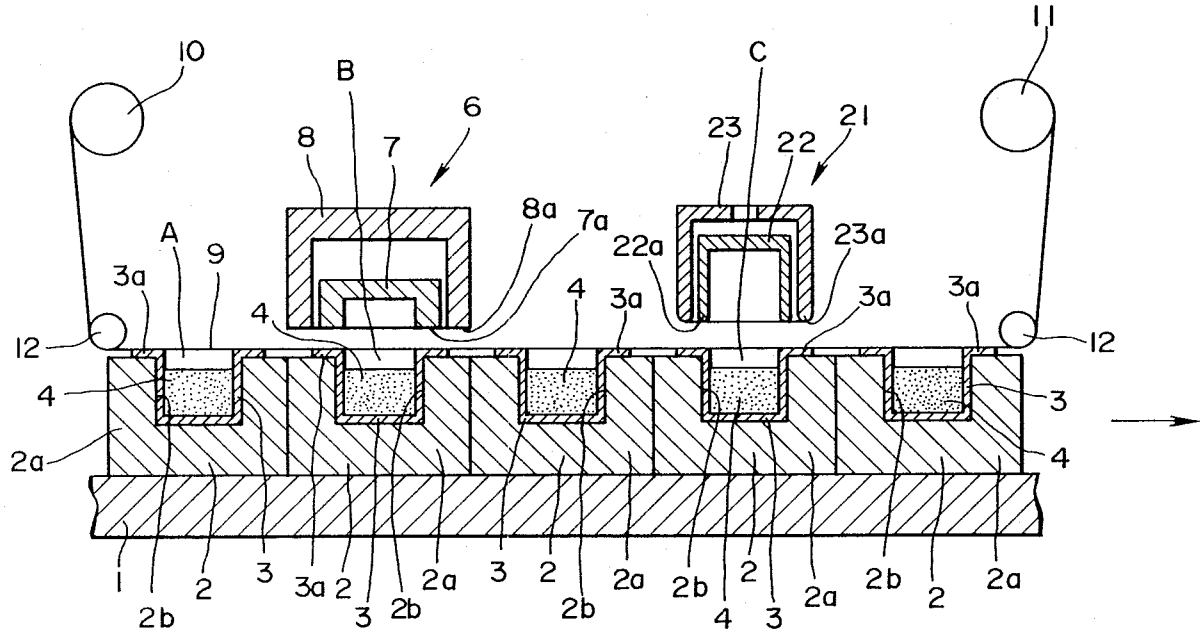
FIG. 16 is a schematic sectional view of a packaging apparatus according to the invention in which the heat sealer of the type as shown in FIG. 9 is used.

FIG. 16 shows a packaging apparatus according to the invention. In this apparatus, the above-explained heat sealer 21 is added, as a second heat sealing unit, to the inert gas-filling and packaging apparatus described before. Accordingly, this apparatus is not illustrated particularly with reference to FIG. 16, in which like reference numerals denote like parts of FIGS. 1 to 15. It will be noted, however, that the first heat sealing unit 6 includes the heat-sealing member 7 with contact portion *7a* of a rectangular form which has a surface of a moderate knurling or texture pattern.

In the apparatus of this embodiment, when the container 3 reaches the position A, the opening of the container is covered with the film 9. This film 9 is subjected to the first heat sealing when the covered film reaches the position B below the first heat sealing unit or mechanism 6. When the sealed container 3 arrives at a position C below the second heat sealing unit 21, final sealing is effected.

This apparatus is advantageous in that since the sealing film 9 is first heat sealed to the flange 3*a* of the container 3 by means of the first heat sealing unit 6 in the form of a texture and is fully heat sealed by means of the heat sealer 21, the sealability for the inert gas and the affinity between the film 9 and the container 3 become better. In addition, the film 9 can be heat sealed in an easily peelable manner.

As will be apparent from the foregoing, the inert gas-filling and packaging apparatus of the invention enables one to give final products of good appearance without involving deposition of a content on a nozzle used to fill an inert gas and further deposition of the content to a flange of a container under which the flange is heat sealed. After the heat sealing, the sealed film is substantially free of any wrinkles. Moreover, the apparatus is simple in mechanism and allows inert gas filling and packaging using only a small amount of the inert gas while attaining a very high substitution rate of the inert gas.

The heat sealer according to the invention ensures a sufficient heat seal strength for preventing separation of a sealed film while permitting the sealed film to be easily peeled from an outer side thereof. The inner and outer sealing members are, respectively, controllable with respect to the sealing width, sealing form and sealing pressure, ensuring necessary heat seal strengths for the respective sealed portions.

The packaging apparatus using the heat sealer is advantageous in that the final package has a high retention of an inert gas and good sealability between a sealing film and a container and that the sealed film can be easily opened.

Although the invention has been described in its preferred form with a certain degree of particularity, obviously many changes and variations are possible therein. It is therefore to be understood that the invention may be practiced otherwise than specifically described herein without departing from the scope and spirit thereof.

What is claimed is:

1. An inert gas filling and sealing apparatus which is adapted to fill an inert gas in containers, each having a content, and seal the containers one by one after coverage of an opening of the container with a sealing film, the apparatus comprising:

a plurality of buckets for individually receiving a container having an upper opening, the plurality of buckets being moved in a predetermined direction;

a film supplying means for supplying a sealing film arranged to move over the plural buckets in synchronism with a moving speed of the plural buckets and to cover one of the plural containers in position;

a vertically movable keep pad having a contact member and capable of moving downward to keep the sealing film in contact with the upper face of the bucket through the contact member when the film is placed in position for coverage of the opening of the container, the contact member having grooves provided at right-angle sides with respect to the direction of the movement of the plural buckets, through which a nozzle is inserted to inject an inert gas and air in the container is expelled by the action of the injected gas, respectively;

a nozzle located at one side of the moving buckets and capable of moving laterally substantially at right angles with respect to the direction of the movement of the plural buckets and injecting the inert gas from the tip thereof through the insertion groove of the keep pad when the film is brought into contact with the upper face of the bucket; and a vertically movable heat sealing means normally located above the plural buckets, surrounded with the keep pad so that the keep pad and the heat sealing means are separately movable, and having a tip member of a form corresponding to a margin of the opening of the container, whereby when the sealing film is urged against the upper face of the bucket, the nozzle is advanced until the tip is inserted through the nozzle insertion groove, from which an inert gas is injected into the container to expel the air to outside from the other groove, and the heat-sealing means descends to heat seal the film along the margin of the container.

2. The apparatus according to claim 1, wherein the nozzle has a length which allows its tip not to contact the content in the container.

3. A heat sealer which is adapted for heat sealing a container along a marginal portion of an opening of the container with a sealing film, the heat sealer comprising a vertically movable inner sealing member of a form suitable for heat sealing the container, the inner sealing member having a tip press portion projected at the center with respect to the thickness of the inner sealing member, and a vertically movable outer sealing member arranged to surround the inner sealing member while keeping a space therebetween and having a tip press portion projected at the center with respect to the thickness of the outer sealing member, the inner and outer sealing members, being arranged such that when a sealing film placed on the container is heat-sealed, the film is pressed at a higher force at the tip press portion of the inner sealing member than at the outer sealing member.

4. The heat sealer according to claim 3, wherein a ratio between a contact width of the tip press portion of the inner sealing member and a contact width of the tip press portion of the outer sealing member is in the range of 1:2 to 2:3.

5. The heat sealer according to claim 3, wherein the tip press portions of the inner and outer sealing members have, respectively, a semi-circular form in section.

6. The heat sealer according to claim 3, wherein the tip press portion of the inner sealing member has a ship's bottom or triangular form in section.

7. The heat sealer according to claim 3, wherein the tip press portion of the outer sealing member has an oval form in section.

8. An inert gas-filling and packaging apparatus which is adapted to fill an inert gas in containers, each having a content and seal the containers one by one after coverage of an opening of the container with a sealing film, the apparatus comprising:

a plurality of buckets for individually receiving a container having an upper opening, the plurality of buckets being moved in a given direction;

a film supplying means for supplying a sealing film arranged to move over the plural buckets in synchronism with a moving speed of the plural buckets and to cover one of the plural containers in position;

a vertically movable keep pad having a contact member and capable of moving downward to keep the sealing film in contact with the upper face of the buckets through the contact member when the film is placed in position for coverage of the opening of the container, the contact member having grooves provided at right-angle sides with respect to the direction of the movement of the plural buckets, through which the nozzle is inserted to inject an inert gas and air in the container is expelled by the action of the injected gas, respectively;

a nozzle located at one side of the moving buckets and capable of moving laterally substantially at right angles with respect to the direction of the movement of the plural buckets and injecting the inert gas from the tip thereof through the insertion groove of the keep pad when the film is brought into contact with the upper face of the bucket;

a first vertically movable heat sealing means normally located above the plural buckets, surrounded with the keep pad so that the keep pad and the heat sealing means are separately movable, and having a tip member of a form corresponding to a margin of the opening of the container, the tip member having a contact portion which has a knurling or texture pattern on the surface thereof so that the sealing film is provisionally heat sealed; and a second vertically movable heat sealing means located downstream of the first sealing means with respect to the direction of the movement of the buckets, the second sealing means including a vertically movable inner sealing member of a form suitable for heat sealing the container, the inner sealing member having a tip press portion projected at the center with respect to the thickness of the inner sealing member, and a vertically movable outer sealing member arranged to surround the inner sealing member while keeping a space therebetween and having a tip press portion projected at the center with respect to the thickness of the outer sealing member, the inner and outer sealing members, being arranged such that when a sealing film placed on the container is heat-sealed, the film is pressed at a higher force at the tip press portion of the inner sealing member than at the outer sealing member, whereby the sealing film is provisionally heat sealed by means of the first sealing member and finally heat sealed by means of the second sealing means, after substitution of the air in the container with the inert gas, in such a way that the second heat sealing allows easy peeling.

* * * * *